US007220162B2

(12) United States Patent
Tanaka

(10) Patent No.: US 7,220,162 B2
(45) Date of Patent: May 22, 2007

(54) EYEGLASS LENS PROCESSING APPARATUS

(75) Inventor: Motoshi Tanaka, Gamagori (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 11/443,008

(22) Filed: May 31, 2006

(65) Prior Publication Data

US 2006/0286903 A1 Dec. 21, 2006

(30) Foreign Application Priority Data

May 31, 2005 (JP) ..... P2005-160619

(51) Int. Cl.
*B24B 49/00* (2006.01)

(52) U.S. Cl. ..... 451/5; 451/8

(58) Field of Classification Search ..... 451/5, 451/8–11, 42–44, 57–59, 65–67
See application file for complete search history.

(56) References Cited

U.S. PATENT DOCUMENTS

| | | | | |
|---|---|---|---|---|
| 5,333,412 | A | 8/1994 | Matsuyama | |
| RE35,898 | E | 9/1998 | Shibata et al. | |
| 6,095,896 | A | 8/2000 | Kobayashi | |
| 6,099,383 | A | 8/2000 | Mizuno et al. | |
| 6,241,577 | B1 | 6/2001 | Shibata | |
| 6,325,700 | B1 * | 12/2001 | Mizuno et al. | 451/8 |
| 6,409,574 | B1 * | 6/2002 | Shibata | 451/5 |
| 6,719,609 | B2 * | 4/2004 | Mizuno et al. | 451/10 |
| 6,942,542 | B2 * | 9/2005 | Shibata | 451/5 |
| 6,984,161 | B2 * | 1/2006 | Suzuki et al. | 451/5 |

FOREIGN PATENT DOCUMENTS

| | | | |
|---|---|---|---|
| JP | 4-93164 | A | 3/1992 |
| JP | 5-212661 | A | 8/1993 |
| JP | 10-225855 | A | 8/1998 |
| JP | 10-249692 | A | 9/1998 |
| JP | 11-70451 | A | 3/1999 |

OTHER PUBLICATIONS

European Search Report for EP 06 01 1281 dated Sep. 26, 2006.

* cited by examiner

*Primary Examiner*—Dung Van Nguyen
(74) *Attorney, Agent, or Firm*—Sughrue Mion, PLLC

(57) ABSTRACT

An eyeglass lens processing apparatus includes; a lens holding unit that holds an eyeglass lens; a data input unit that inputs target lens shape data; a lens measuring unit that measures a refractive surface of the held lens based on the input target lens shape data to obtain an edge position of the lens; and a controller that detects presence or absence of a foreign body on the lens refractive surface based on the obtained edge position data.

5 Claims, 10 Drawing Sheets

EYEGLASS LENS PROCESSING APPARATUS

BACKGROUND OF THE INVENTION (1) Technical Field

The present invention relates to an eyeglass lens processing apparatus for processing an eyeglass lens.

(2) Related Art

In an eyeglass lens processing apparatus, an eyeglass lens is held (chucked) by two lens chuck shafts and is rotated, while the peripheral edge of the lens is processed by a processing tool such as a grindstone so that the lens can have a shape substantially identical with a target lens shape (traced outline). To hold the lens, a cup serving as a fixing jig is mounted on and fixed to a front refractive surface of the lens through a double-sided adhesive tape, the cup with the lens fixed thereto is mounted on a cup receiver at a distal end of one of the two lens chuck shafts, and a lens holder at a distal end of the other lens chuck shaft is brought into contact with a rear refractive surface of the lens. Further, to hold a lens having a refractive surface easy to slip such as a lens on which a water repellant coating is enforced, a film-shaped adhesive sheet may be bonded onto the refractive surface of the lens and, after then, the cup is mounted on and fixed to the lens through a double-sided adhesive tape.

When processing the lens, the shape of the lens is measured (the edge position of the lens is detected) in accordance with the target lens shape. In this case, when the adhesive tape is bonded in such a manner that it is sticking out of the cup greatly, or when the adhesive sheet is bonded while creased, there is a possibility that an error can be included in the measuring result. And, when the lens is processed based on the processing data that have been obtained from the measuring results containing such error, defective processing can occur. Such defective processing can also occur similarly when some other foreign bodies stick to the refractive surface of the lens.

SUMMARY OF THE INVENTION

The technical object of the present invention is to provide an eyeglass lens processing apparatus which can detect whether foreign bodies exist on a refractive surface of an eyeglass lens or not, thereby being able to prevent the defective processing of the lens previously.

In order to achieve the above object, the present invention is characterized by having the following arrangements.

(1) An eyeglass lens processing apparatus, comprising:

a lens holding unit that holds an eyeglass lens;

a data input unit that inputs target lens shape data;

a lens measuring unit that measures a refractive surface of the held lens based on the input target lens shape data to obtain an edge position of the lens; and a controller that detects presence or absence of a foreign body on the lens refractive surface based on the obtained edge position data.

(2) The eyeglass lens processing apparatus according to (1), wherein the controller detects the presence or absence of the foreign body based on a mutual correlation between a variation of the edge position data and a variation of the target lens shape data.

(3) The eyeglass lens processing apparatus according to (2), wherein the controller detects the presence or absence of the foreign body based on whether an inflection point of the target lens shape data is present or not in the vicinity of an inflection point of the edge position data, or on whether a sharply varying point of the target lens shape data is present or not in the vicinity of a sharply varying point of the edge position data.

(4) The eyeglass lens processing apparatus according to (1), wherein the lens measuring unit measures the lens refractive surface in a first measuring path based on the target lens shape data and a second measuring path arranged a given distance inwardly or outwardly of the first measuring path to obtain the edge position data, and the controller detects the presence or absence of the foreign body based on a difference between the edge position data in the first measuring path and the edge position data in the second measuring path.

(5) The eyeglass lens processing apparatus according to (1) further comprising a lens processing unit that processes the held lens, wherein the controller limits processing of the lens when the presence of the foreign body is detected.

DETAILED DESCRIPTION OF PREFERED EMBODIMENTS

Figure 1:
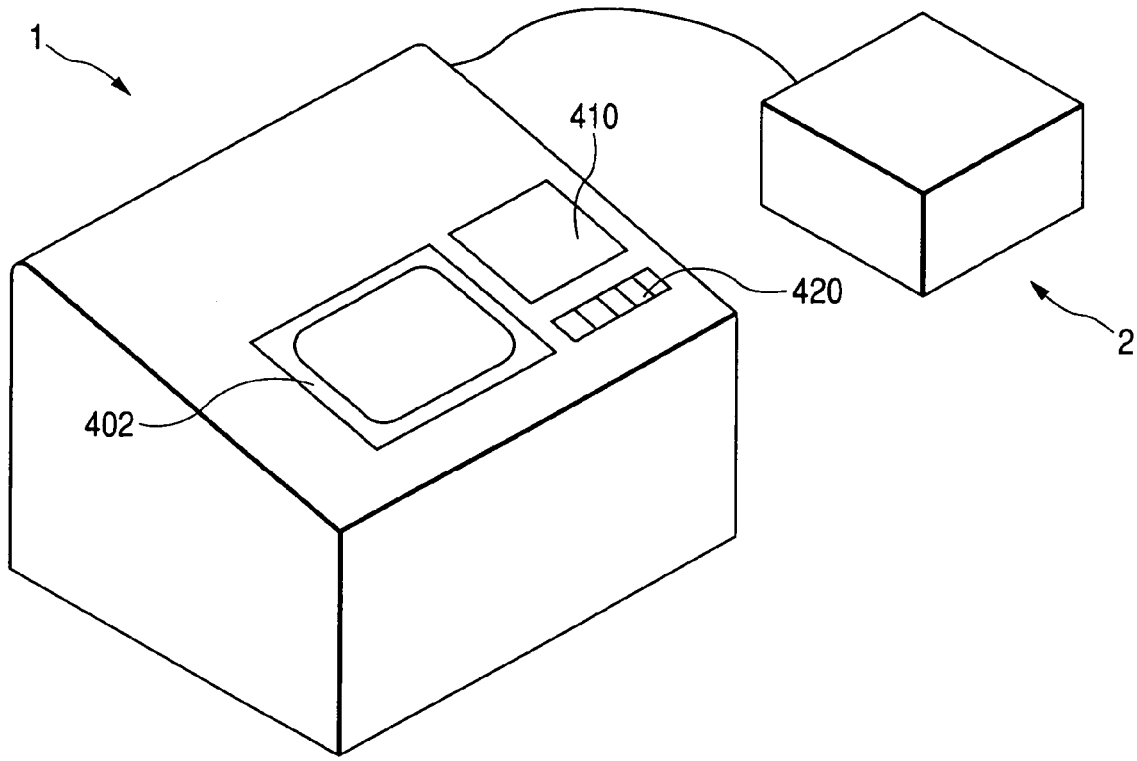
FIG. 1 is a schematic external view of an eyeglass lens processing apparatus according to an embodiment of the invention.

Now, an embodiment according to the invention will be described with reference to the accompanying drawings. FIG. 1 is a schematic external view of an eyeglass lens processing apparatus 1 according to the embodiment of the invention. An eyeglass frame measuring apparatus 2 is connected to the processing apparatus 1. As the measuring apparatus 2, there can be used a measuring apparatus which is disclosed in, for example, U.S. Pat. No. 5,333,412 (Japanese patent publication Hei-4-93164) and U.S. Re. 35898 (Japanese patent publication Hei-5-212661). A touch panel 410 serving not only as a display portion for processing information and the like but also as an input portion for inputting processing conditions and the like, and a switch portion 420 including switches for instruction of processing such as a processing start switch are mounted on the top portion of the processing apparatus 1. A lens to be processed is processed in a processing chamber which is formed within an opening/closing window 402. Incidentally, the processing apparatus 1 may be formed integrally with the measuring apparatus 2.

Figure 2:
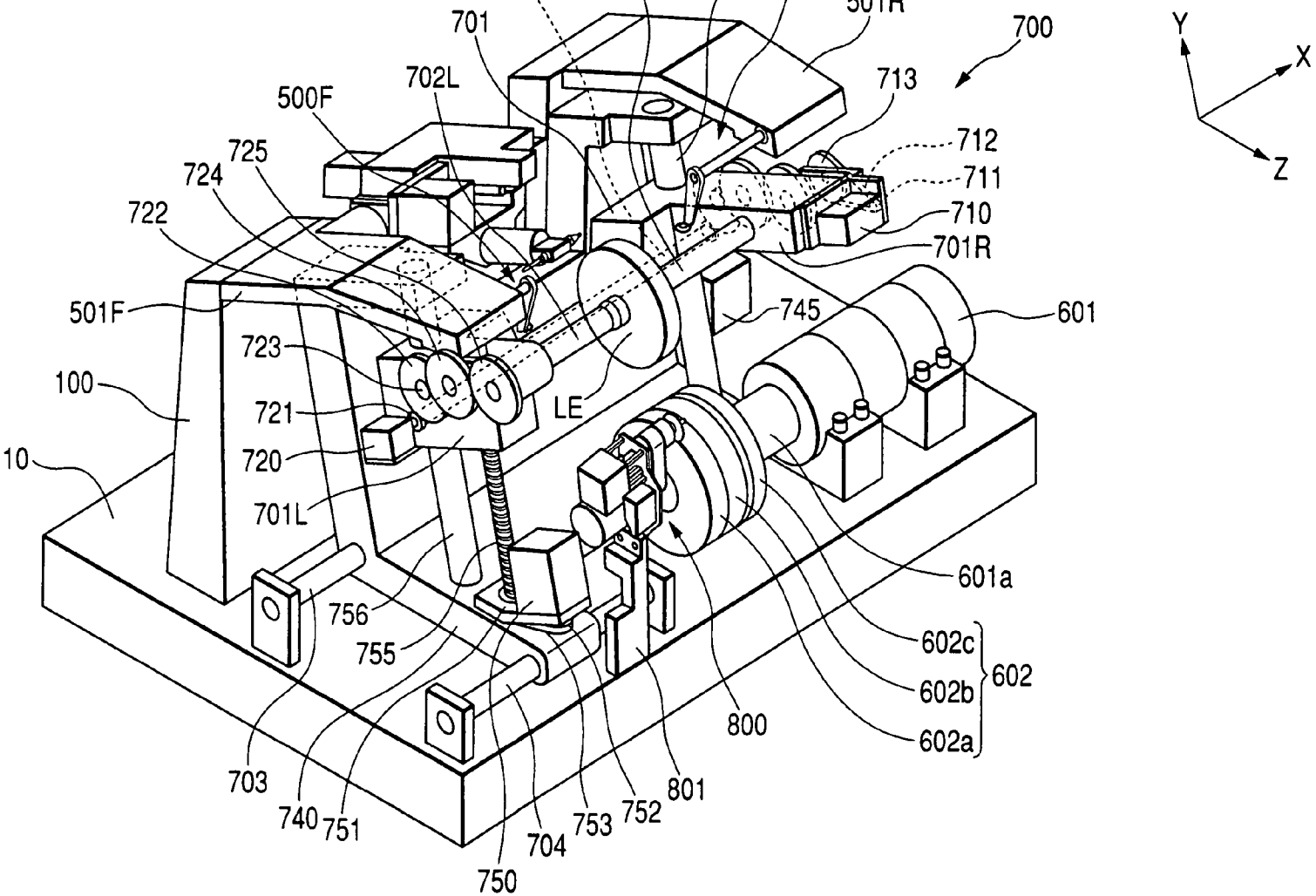
FIG. 2 is a schematic structure view of a lens processing portion of the eyeglass lens processing apparatus.

FIG. 2 is a schematic structure view of a lens processing portion disposed within the box body of the processing apparatus 1. A carriage portion 700 which includes a carriage 701 and its moving mechanism is mounted on a main base 10. A lens LE to be processed is held (chucked) by two lens chuck shafts 702L and 702R respectively rotatably held on the carriage 701, is rotated, and is ground or processed by a grindstone 602. The grindstone 602 according to the present embodiment includes a rough processing grindstone 602*a* for glass, a rough processing grindstone 602*b* for plastics, and a processing grindstone 602*c* for bevel-finishing and flat-finishing. A grindstone rotating shaft 601*a*, on which the grindstone 602 is mounted, is connected to a grindstone rotating motor 601.

The chuck shafts 702L and 702R are held on the carriage 701 in such a manner that their axes (the axis of rotation of the lens LE) are parallel to an axis of the shaft 601*a* (the axis of rotation of the grindstone 602). The carriage 701 can be moved not only in a direction of the axis of the shaft 601*a* (a direction of the axes of the chuck shafts 702L and 702R) (in the X-axis direction) but also in a direction perpendicular to the X-axis direction (in a direction where the distance between the axes of the chuck shafts 702L and 702R and the axis of the shaft 601*a* is varied) (in the Y-axis direction).

<Lens Holding (Chucking) Mechanism>

The chuck shaft 702L is held on a left arm 701L of the carriage 701 and the chuck shaft 702R is held on a right arm 701R thereof in such a manner that they can be rotated and are coaxial with each other. A cup receiver 730 is mounted on the distal end of the chuck shaft 702L. A lens holder 731 is mounted on the distal end of the chuck shaft 702R (see FIG. 3). A lens holding (chucking) motor 710 is fixed to the right arm 701R. The rotational movement of the motor 710 is transmitted through a pulley 711 mounted on the rotation shaft of the motor 710, a belt 712 and a pulley 713 to a feed screw (not shown) connected to the pulley 713; the rotational movement of the feed screw moves a feed nut (not shown) in the axial direction thereof, the feed nut being threadedly engaged with the feed screw; and, the movement of the feed nut moves the chuck shaft 702R in the axial direction thereof, the chuck shaft 702R being connected with the feed nut. As a result of this, the chuck shaft 702R is moved in a direction to approach the chuck shaft 702L, so that the lens LE can be held (chucked) by the chuck shafts 702L and 702R.

<Lens Rotating Mechanism>

A lens rotating motor 720 fixed to the left arm 701L. The rotational movement of the motor 720 is transmitted through a gear 721 mounted on the rotation shaft of the motor 720, a gear 722, a gear 723 coaxial with the gear 722, a gear 724, and a gear 725 mounted on the chuck shaft 702L to the chuck shaft 702L, so that the chuck shaft 702L can be rotated. Further, the rotational movement of the motor 720 is transmitted to the chuck shaft 702 through a rotary shaft 728 connected to the rotation shaft of the motor 720 and gears respectively similar to the gears 721–725, thereby rotating the chuck shaft 702R. As a result of this, the chuck shafts 702L and 702R are rotated synchronously with each other, thereby rotating the lens LE which is held (chucked) by them.

<X-axis Direction Moving Mechanism of Carriage 701>

A moving support base 740 is movably supported by two guide shafts 703 and 704 which are fixed on the base 10 to be parallel thereto and extend in the X-axis direction. Further, an X-axis direction moving motor 745 is fixed on the base 10. The rotational movement of the motor 745 is transmitted to the support base 740 through a pinion gear (not shown) mounted on the rotation shaft of the motor 745 and a rack gear (not shown) mounted on the rear portion of the support base 740, so that the support base 740 can be moved in the X-axis direction. As a result of this, the carriage 701 supported by two guide shafts 756 and 757 respectively fixed to the support base 740 can be moved in the X-axis direction.

<Y-axis Direction Moving Mechanism of Carriage 701>

The carriage 701 is movably supported by the guide shafts 756 and 757 which are fixed to the support base 740 to be parallel thereto and extend in the Y-axis direction. Further, a Y-axis direction moving motor 750 through a plate 751 is fixed to the support base 740. The rotational movement of the motor 750 is transmitted through a pulley 752 mounted on the rotation shaft of the motor 750 and a belt 753 to a feed screw 755 which is rotatably held on the plate 751; and, owing to the rotational movement of the feed screw 755, the carriage 701 with which the feed screw 755 is threadedly engaged is moved in the Y-axis direction.

Lens shape measuring portions 500F and 500R are disposed above the carriage 701. A chamfering/grooving portion 800 is arranged in front of the carriage 701.

Figure 3:
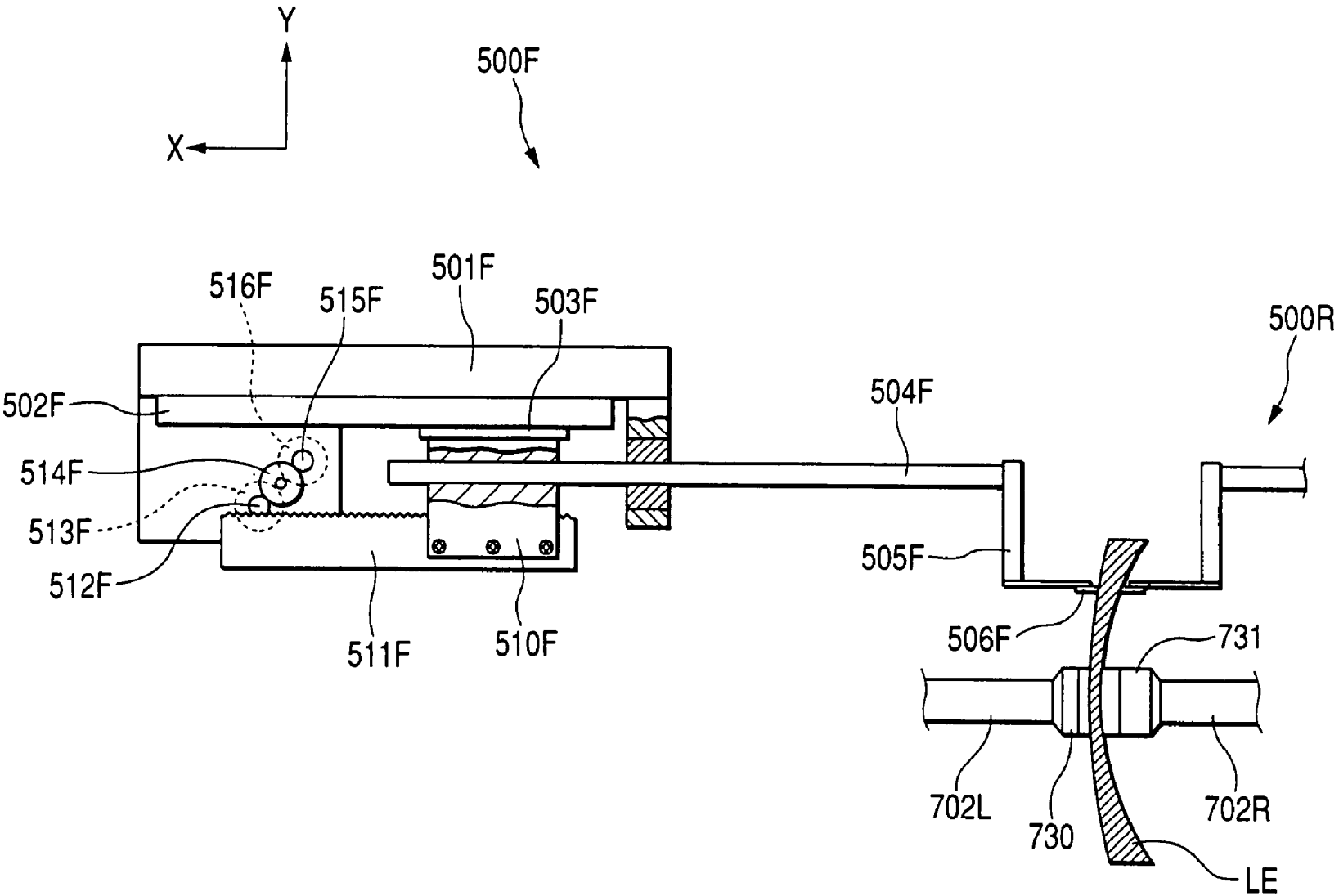
FIG. 3 is a schematic structure view of a lens shape measuring portion of the eyeglass lens processing apparatus.

Now, FIG. 3 is a schematic structure view of the lens shape measuring portion 500F for measuring the shape of the front refractive surface of the lens LE. A fixed support base 501F is fixed mounted on a sub-base 100 standing on the main base 10 (see FIG. 2); and a slider 503F is movably supported by a guide rail 502F fixed to the support base 501F and extending in the X-axis direction. A moving support base 510F is fixed to the slider 503F; and, a feeler arm 504F is fixed to the support base 510F. An L-shaped feeler hand 505F is fixed to the distal end of the arm 504F; and a disk-shaped feeler 506F is fixed to the distal end of the hand 505F. When measuring the shape of the front refractive surface of the lens LE, the feeler 506F is brought into contact with the front refractive surface of the lens LE.

A rack gear 511F is fixed to the lower portion of the support base 510F; and a pinion gear 512F which is mounted on the rotation shaft of an encoder 513F fixed to the support base 501F is engaged with the gear 511F. Further, a motor 516F is fixed to the support base 501F. The rotational movement of the motor 516F is transmitted to the gear 511F through a gear 515F mounted on the rotation shaft of the motor 516F, a gear 514F, and the gear 512F, so that the gear 511F, support base 510F, arm 504F and the like are moved in the X-axis direction. During the measuring operation, the motor 516F is always pressing the feeler 506F against the front refractive surface of the lens LE with a constant force. The encoder 513F detects the moving amount of the support base 510F or the like in the X-axial direction (the position of the feeler 506F). In accordance with the thus detected moving amount (position) and the rotation angles of the chuck shafts 702L and 702R, the shape of the front refractive surface of the lens LE is measured.

Incidentally, the lens shape measuring portion 500R for measuring the shape of the rear refractive surface of the lens LE is symmetrical to the lens shape measuring portion 500F and, therefore, the description thereof is omitted here.

Figure 4:
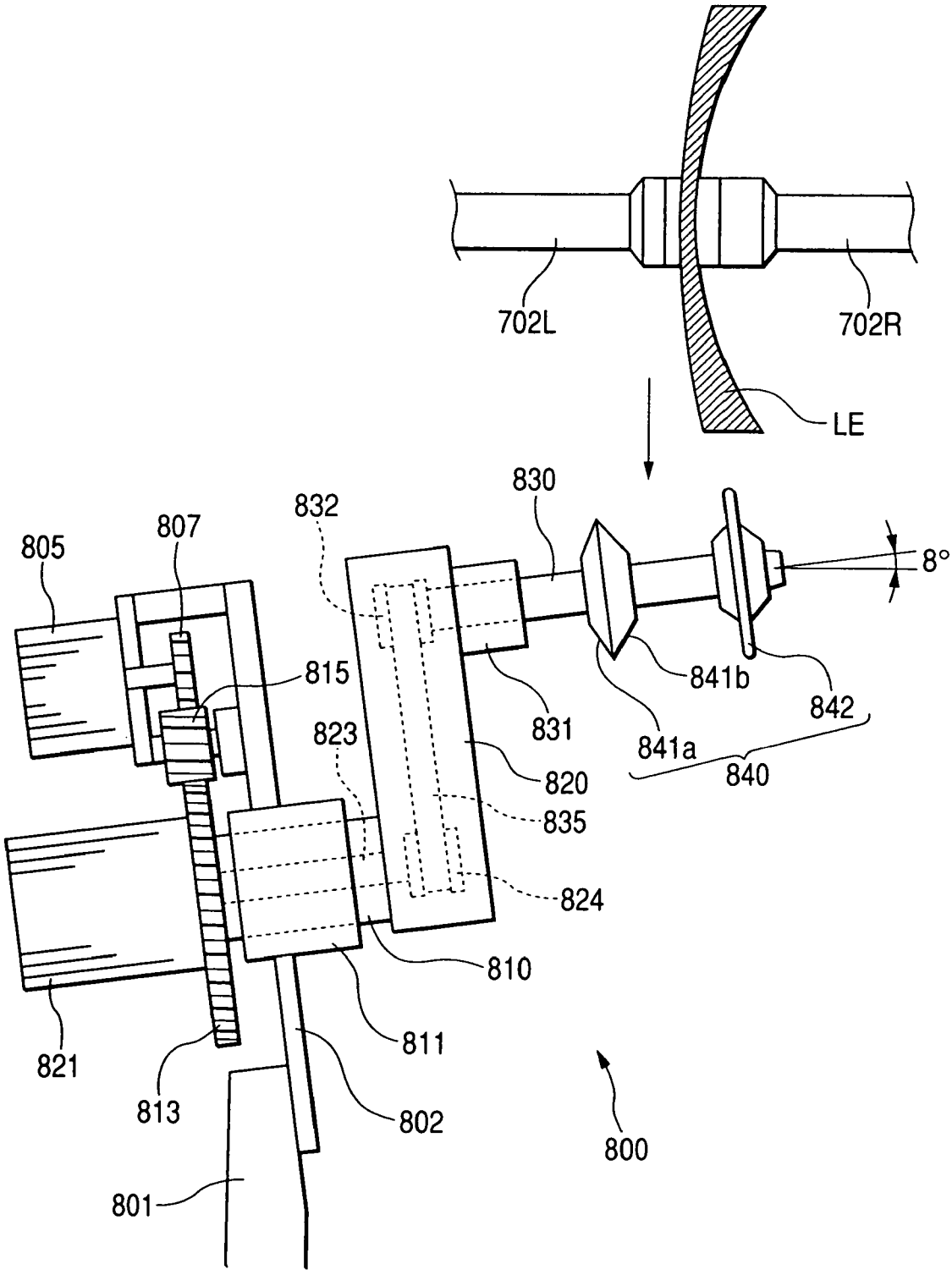
FIG. 4 is a schematic structure view of a chamfering/grooving portion of the eyeglass lens processing apparatus.

Now, FIG. 4 is a schematic structure view of the chamfering and grooving portion 800. A fixed support base 801, which serves as the base of the chamfering and grooving portion 800, is fixed to the upper surface of the base 10 (see FIG. 2) and, a plate 802 is fixed to the support base 801. A motor 805, which is used to rotate an arm 820 and thereby move a grindstone portion 840 to its processing position or retreating position, is fixed on the plate 802. A hold member 811 which rotatably holds an arm rotating member 810 is fixed to the plate 802. A gear 813 is fixed to the rotating member 810 which extends leftward of the plate 802. The rotational movement of the motor 805 is transmitted through a gear 807 mounted on the rotation shaft of the motor 805, a gear 815 and the gear 813 to the rotating member 810, so that the arm 820 fixed to the rotating member 810 can be rotated.

A grindstone rotating motor 821 is fixed to the gear 813. The rotational movement of the motor 821 is transmitted to a grindstone rotating shaft 830 through a rotary shaft 823 connected to the rotation shaft of the motor 821 and rotatably held by the rotating member 810, a pulley 824 mounted on the shaft 823, a belt 835, and a pulley 832 mounted on the shaft 830 rotatably held by a hold member 831 which is fixed to the arm 820, so that the shaft 830 can be rotated. As a result of this, a processing grindstone 841*a* for chamfering the rear surface of the lens LE, a processing grindstone 841*b* for chambering the front surface of the lens LE and a processing grinding stone 842 for grooving which are respectively mounted on the shaft 830 can be rotated. The axis of the shaft 830 is set inclined about 8° with respect to the axes of the chuck shafts 702L and 702R, which makes it easy for the grindstone portion 840 to follow the curve of the lens LE. The chamfering grindstones 841*a*, 841*b* and grooving grindstone 842 are respectively set about 30 mm in outer diameter.

In the grooving and chamfering time, the arm 820 is rotated by the motor 805, while the grindstone portion 840 is moved to its retreating position or processing position. The processing position of the grindstone portion 840 is a position which exists between the chuck shafts 702L, 702R and the shaft 601*a* and where the rotation axis of the shaft 830 is set on a plane on which the rotation axes of the two kinds of shafts are present. Owing to this, similarly to the peripheral edge processing operation by the grindstone 602, the axis-to-axis distance between the rotation axes of the chuck shafts 702L, 702R and the rotation axis of the shaft 830 can be varied by the motor 751.

Figure 5:
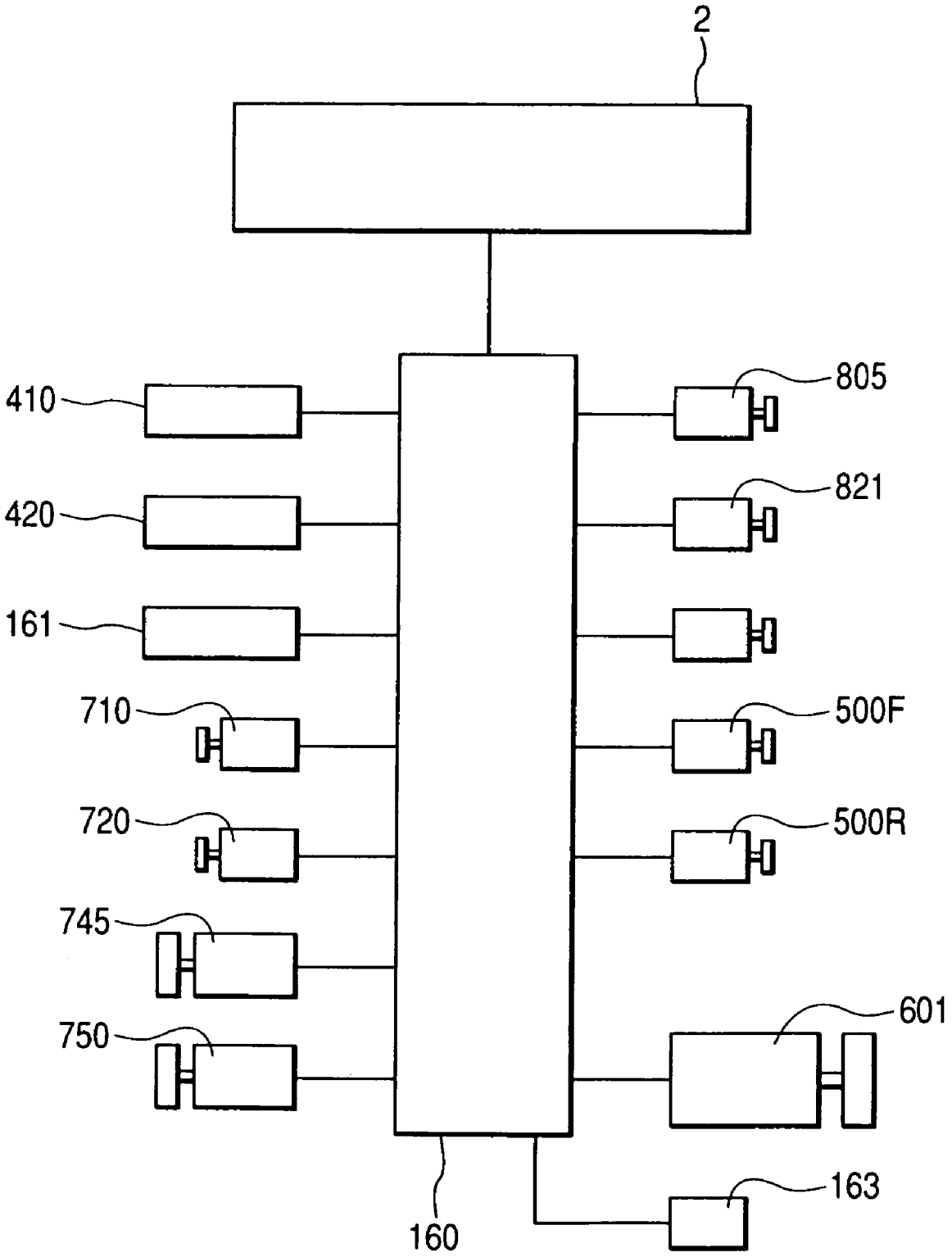
FIG. 5 is a schematic block diagram of a control system of the eyeglass lens processing apparatus.

Now, the operation of the apparatus having the above-mentioned structure will be described below with reference to a schematic block diagram of a control system shown in FIG. 5.

Figure 7:
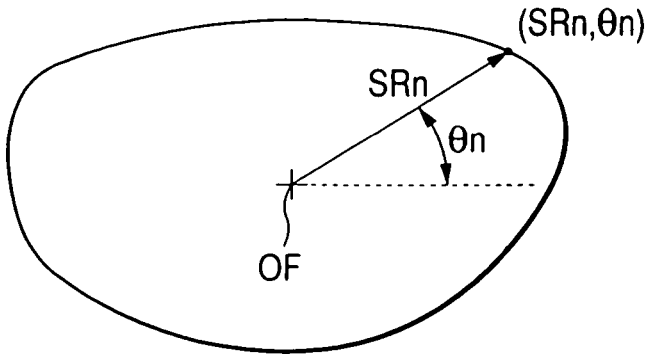
FIG. 7 is an explanatory view of target lens shape data.

Firstly, the shapes of right and left rims of an eyeglass frame are measured using the measuring apparatus 2, thereby obtaining target lens shape data thereof. In the case of a rimless frame or the like, the shape of a template or the shape of a dummy lens is measured, thereby obtaining target lens shape data thereof. The target lens shape data from the measuring apparatus 2 are input to the processing apparatus 1 by pressing down a communication key displayed on a touch panel 410 and the data are then stored in a memory 161 as target lens shape data (SRn, θn) (n=1, 2, - - - , N) (see FIG. 7) each composed of a radial length SRn and a radial angle θn with the geometric center OF of the target lens shape as a reference. Incidentally, the target lens shape data may be input from an external computer or the like through communication means (not shown), or may be input through a bar code reader or the like. When the target lens shape data is input, a target lens shape figure is displayed on the screen of the touch panel 410 based on the target lens shape data. An operator may operate a touch key displayed on the touch panel 410 to input lay-out data such as FPD (distance between the geometric centers of the right and left rims), PD of a eyeglass wearer (distance between pupils-centers of the eyeglass wearer), the height of an optical center of the lens LE with respect to the geometric center OF of the target lens shape, and the like. Further, the operator may operate a touch key displayed on the touch panel 410 to thereby set (input) the material of the lens LE, the kind of the eyeglass frame, the processing mode, whether a chamfering operation is necessary or not, and the like. When these processing conditions are set once, according to a program stored in a memory 163 in advance, a processing procedure and the like are decided by a main control portion 160.

Figure 6A:
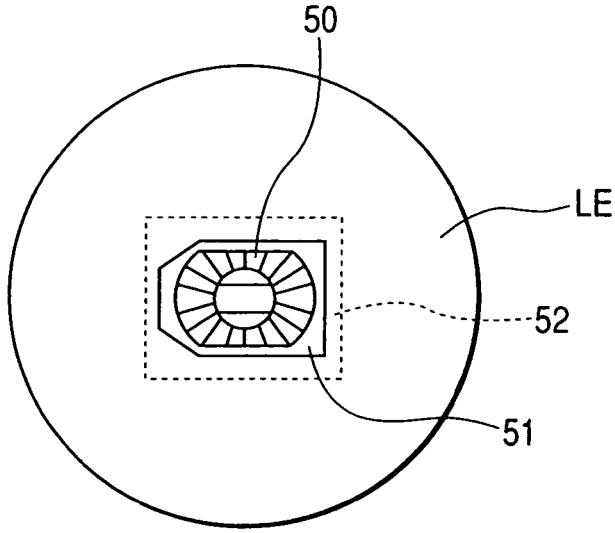
FIGS. 6A and 6B are explanatory views to show how to fix a cup to the refractive surface of a lens.
Figure 6B:
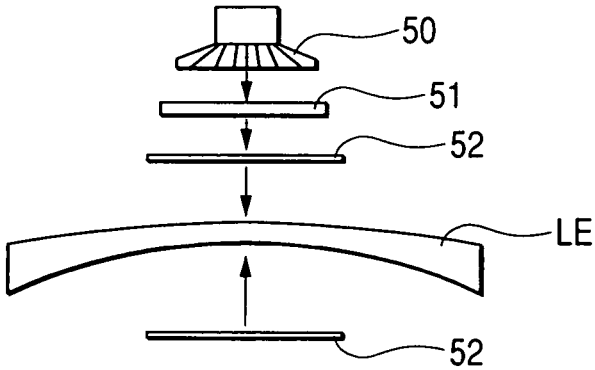

Before or after the above operation, as a previous step to be executed prior to the operation in which the lens LE is held (chucked) by the chuck shafts 702L and 702R, as shown in FIGS. 6A and 6B, a cup 50 is mounted on and fixed to the front refractive surface of the lens LE using a blocking device. The cup 50 is mounted on and fixed to the lens LE through a double-sided adhesive tape 51. Further, in the case of a lens having a refractive surface easy to slip such as a lens with a water-repellent coating enforced thereon, a film-shaped adhesive sheet 52 may be firstly bonded to the front refractive surface of the lens and, after then, the cup 50 may be mounted on and fixed to the lens through the tape 51. Incidentally, in order to make it difficult for the lens holder 731 to slip, the sheet 52 may also be bonded to the rear refractive surface of the lens.

After completion of the mounting and fixation of the cup 50 to the front refractive surface of the lens LE, the base portion of the cup 50 is mounted on the cup receiver 730. Then, when the lens holding (chucking) switch of the switch portion 420 is pressed down, the chuck shaft 702R is moved in the direction to approach the chuck shaft 702L, the lens holder 731 is contacted with the rear refractive surface of the lens LE, and the lens LE is held (chucked) by the chuck shafts 702L and 702R.

When the processing start switch of the switch portion 420 is depressed, the main control portion 160 controls the lens shape measuring portions 500F and 500R in accordance with the target lens shape data input therein, thereby measuring the shape of the lens LE (detecting the edge position thereof). Incidentally, when the cup 50 is fixed to the lens LE in such a manner that the axis of the cup 50 is coincident with the optical center of the lens LE (optical center holding (chucking) mode), the target lens shape data stored in the memory 161 with the geometric center OF of the target lens shape as a reference are converted to the target lens shape data with the optical center thereof as a reference in accordance with the layout data such as the input FPD, PD and optical center height, and are used. Further, when the cup 50 is fixed to the lens LE in such a manner that the axis of the cup 50 is coincident with the geometric center (boxing center) of the target lens shape laid out for the lens LE (boxing center holding (chucking) mode), the target lens shape data with the geometric center OF of the target lens shape as a reference stored in the memory 161 can be used as they are. Now, description will be given below of the boxing center holding mode.

The main control portion 160 drive the motor 516 F to move the arm 504F from its retreating position to its measuring position and, after then, in accordance with the target lens shape data, drives the motor 750 to move the carriage 701 and drives the motor 516F to move the arm 504F toward the lens LE (in a direction to approach the lens LE), thereby bringing the feeler 506F into contact with the front refractive surface of the lens LE. Then, in a state where the feeler 506F is in contact with the front refractive surface, the main control portion 160 drives the motor 750 in accordance with the target lens shape data, while driving the motor 720 to rotate the lens LE, to thereby move up and down the carriage 701. With such rotation and movement of the lens LE, the feeler 506F is moved in the axial direction of the chuck shafts 702L and 702R (in the X-axis direction) along the shape of the front refractive surface of the lens LE. The amount of this movement is detected by the encoder 513F, so that the shape of the front refractive surface of the lens LE(SRn, θn, zfn) (n=1, 2, - - - , N) is measured. Incidentally, zfn expresses the height (thickness) of the front refractive surface of the lens LE. The shape of the rear refractive surface of the lens LE(SRn, θn, zrn) (n=1, 2, - - - , N) is measured by the lens shape measuring portion 500R. Here, zrn expresses the height (thickness) of the rear refractive surface of the lens LE. The data of the shapes of the front and rear refractive surfaces of the lens LE are stored in the memory 161.

Further, the main control portion 160 detects whether a foreign body is present or not on the refractive surface of the lens LE in accordance with the measured (detected) results of the lens shape (edge position). The foreign body on the refractive surface of the lens LE includes, for example, the tape 51 bonded in such a manner that it sticks greatly out of the cup 50 which often occurs when the lens LE is processed so as to substantially coincide with a target lens shape which has a narrow top-and-bottom width (vertical width), the sheet 52 bonded in a creased manner, or a processing waste remaining within the processing chamber.

Figure 8:
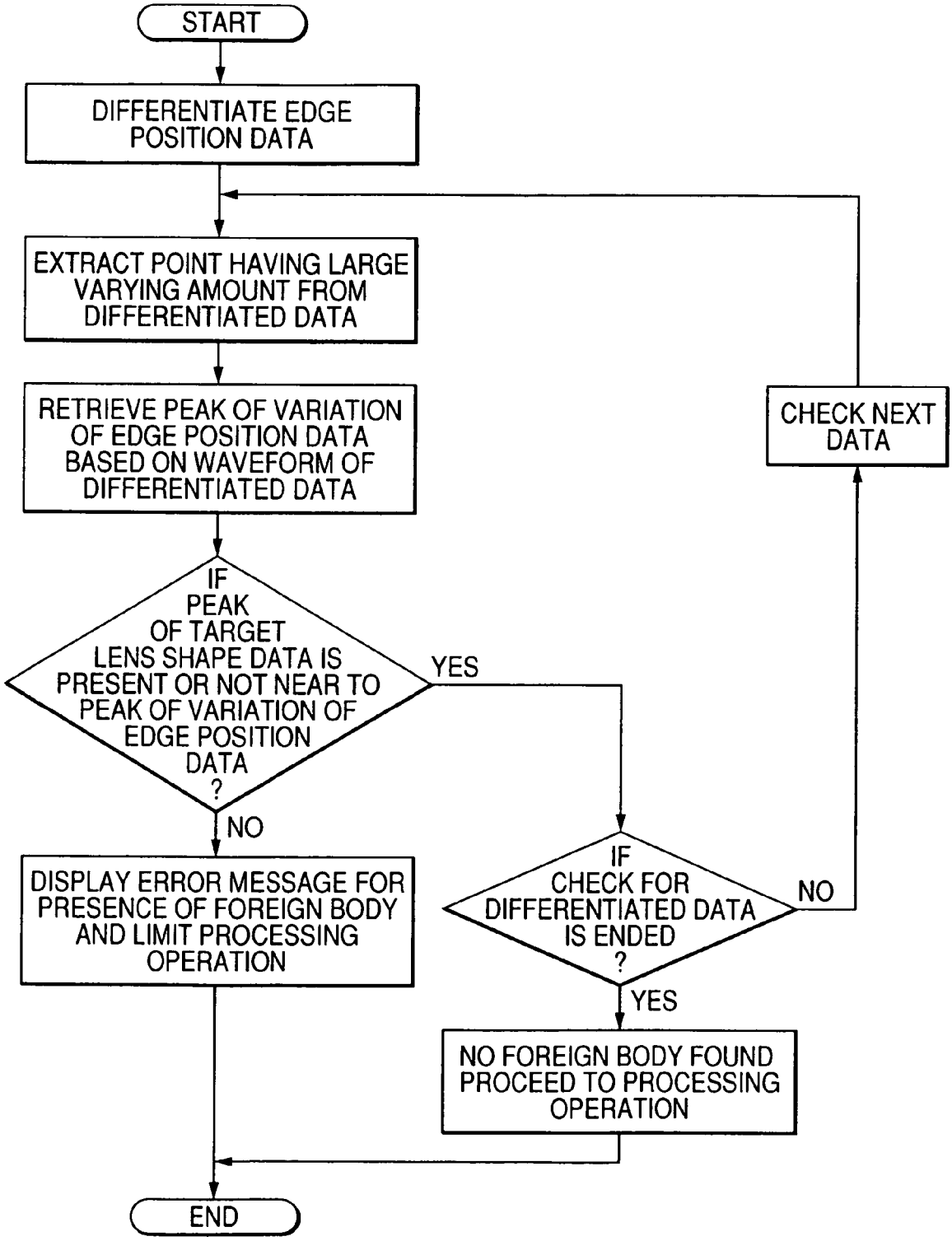
FIG. 8 is a flow chart to show how to detect whether a foreign body is present on the refractive surface of the lens or not.
Figure 9A:
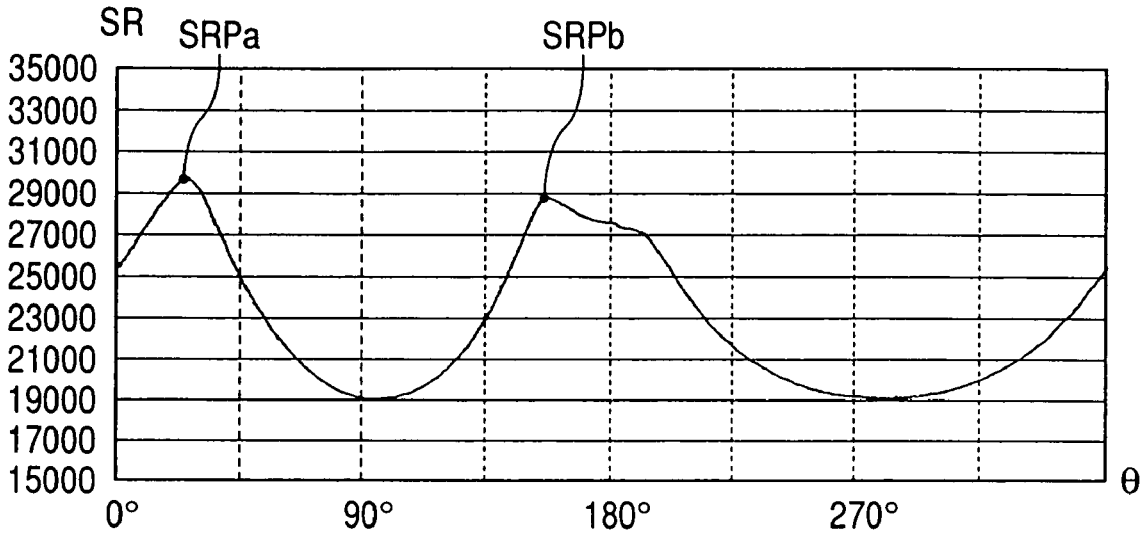
FIGS. 9A and 9B are views to show the target lens shape data and the edge position data of the front surface of the lens.
Figure 9B:
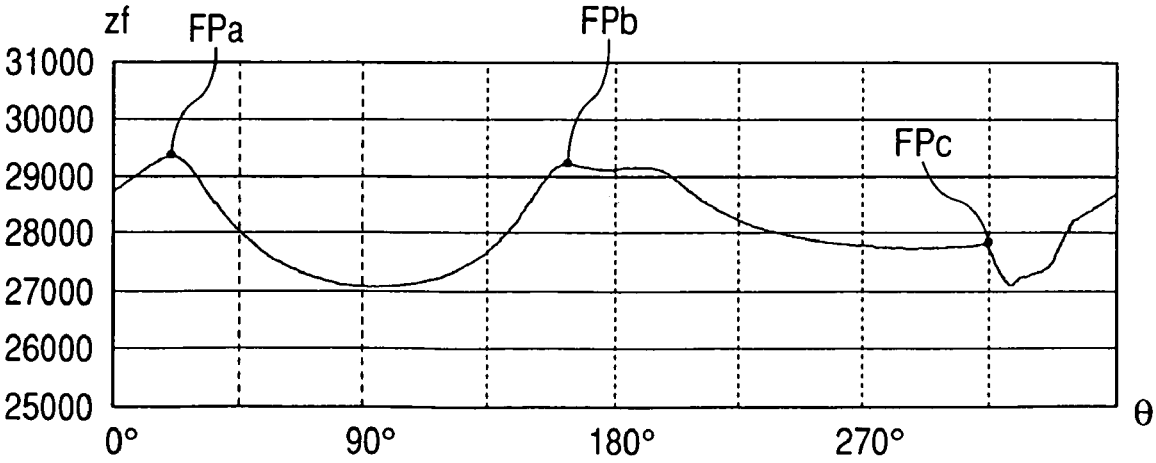

Now, description will be given below of a method for detecting the foreign body on the front refractive surface of the lens LE (see a flow chart shown in FIG. 8). Here, FIG. 9A is a graphical representation of the target lens shape data shown in FIG. 7, in which the horizontal axis expresses the radial angle θ and the vertical axis expresses the radial length SR. FIG. 9B is a graphical representation of the measured (detected) results of the front refractive surface shape (edge position) of the lens LE, in which the horizontal axis expresses the radial angle θ and the vertical axis expresses the edge position zf from the reference position (distance from the reference position to the edge).

Figure 10:
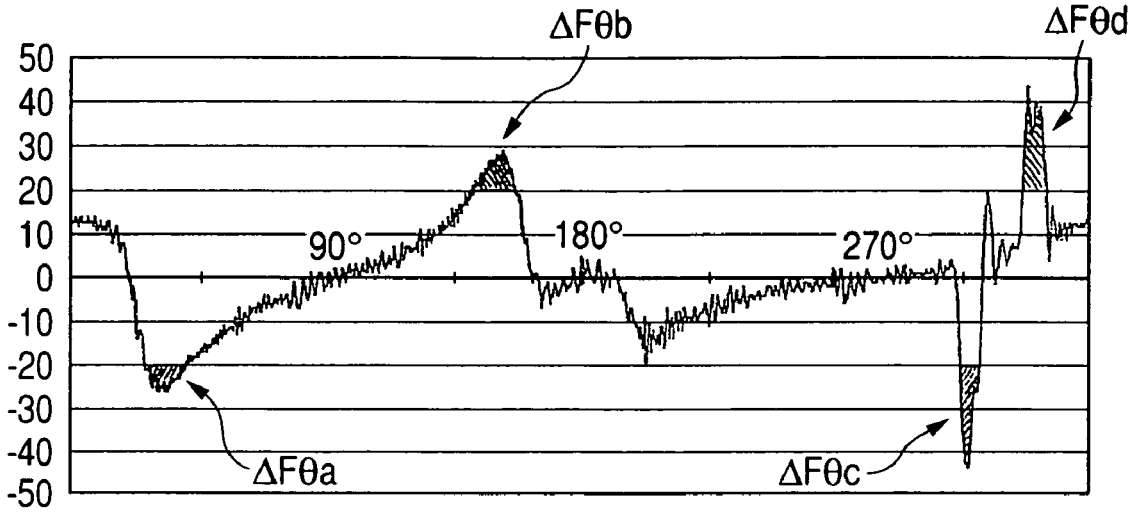
FIG. 10 is a view of differentiated data of the edge position data.

Firstly, the main control portion 160 differentiates the edge position data shown in FIG. 9B. FIG. 10 shows the results of the differentiation of the edge position data. Then, the main control portion 160 extracts points (radial angles) having a large varying amount from the differentiated data. The reason for this is that, if there is present any foreign body such as the tape 51 on the refractive surface of the lens LE, normally, a sharp variation occurs in the edge position data. In FIG. 10, as the points having a large varying amount, portions ΔFθa, ΔFθb, ΔFθc, and ΔFθd which respectively exceed a given threshold value (±20) are extracted. However, when a sharp variation is found in the target lens shape data itself, in some cases, it is difficult to detect the foreign body only by means of the differentiating processing of the edge position data and the threshold value processing of the differentiated data. In view of this, preferably, variations in the edge position data may be compared with variations in the target lens shape data with respect to the same radial angle; and, in accordance with their mutual correlation, presence or absence of the foreign body is detected. In other words, since the lens refractive surface has a curve, when no foreign body is present on the lens refractive surface, the peak of the variation of the edge position data (the inflection point of the edge position data) substantially coincides with the peak of the variation of the target lens shape data (the inflection point of the radial length data). On the other hand, when a foreign body is present on the lens refractive surface, the peak of the variation of the edge position data appears even in a point where the peak of the variation of the target lens shape data is not found.

The peak of the variation of the edge position data can be extracted from the differentiated data. For example, the peak of the variation of the edge position data shown in FIG. 9B can be retrieved based on the waveform of the differentiated data shown in FIG. 10. In FIG. 10, the portion ΔFθa is firstly extracted as a point having a large variation amount of the differentiated data. Since this portion ΔFθa is a portion which has a large minus value in the differentiated data, by retrieving the increasing side of the edge position data existing leftward of this portion, a point FPa in FIG. 9B is extracted as the peak of the variation of the edge position data. Next, the peak of the variation of the target lens shape data in FIG. 9A is checked whether it is present or not in the vicinity (for example, in the range of ±6°) of the radial angle of the point FPa, and a point SRPa shown in FIG. 9A is extracted as the peak of the variation of the target lens shape data. Therefore, it is judged that the peak FPa of the variation of the edge position data is not caused by a foreign body.

Next, since the portion ΔFθb extracted as a point having a large variation amount in the differentiated data is a portion having a large plus value in the differentiated data, by retrieving the increasing side of the edge position data existing rightward of this portion, a point FPb in FIG. 9B is extracted as the peak of the variation of the edge position data. Next, it is checked whether the peak of the variation of the target lens shape data in FIG. 9A is present or not in the vicinity of the radial angle of the point FPb, and a point SRPb shown in FIG. 9 is extracted as the peak of the variation of the target lens shape data. Therefore, it is judged that the peak FPb of the variation of the edge position data is not caused by a foreign body.

Then, because the portion ΔFθc extracted as a point having a large variation amount in the differentiated data is a portion having a large minus value in the differentiated data, by retrieving the increasing side of the edge position data existing leftward of this portion, then a point FPc in FIG. 9B is extracted as the peak of the variation of the edge position data. Next, it is checked whether the peak of the variation of the target lens shape data in FIG. 9A is present or not in the vicinity of the radial angle of the point FPc. Since no peak of the variation of the target lens shape data is present in the vicinity of the radial angle of the point FPc, it is judged that the peak FPc of the variation of the edge position data is caused by a foreign body.

If it is judged that a foreign body is present on the front and rear refractive surfaces of the lens LE, the main control portion 160 displays an error message or the like on the touch panel 410 and limits (stops) the processing operations to be executed thereafter. The operator must take out the lens LE from the chuck shafts 702L and 702R once, remove the foreign body existing on the refractive surfaces of the lens LE (and bond the tape 51 and sheet 52 again), make the chuck shafts 702L and 702R hold (chuck) the lens LE again, and resume the processing operation. Incidentally, when the processing apparatus is structured such that the existing position of the foreign body can be displayed on the touch panel 410, it is easier for the operator to check the presence or absence of the foreign body.

When the foreign body detection judges that no foreign body is present, the main control portion 160 executes the peripheral edge processing operation of the lens LE. When the lens LE is a plastic lens, the main control portion 160 drives the motor 745 to move the carriage 701 in the X-axis direction and thereby set the lens LE on the grindstone 602*b*; and the main control portion 160 drives the motor 720 to rotate the lens LE and simultaneously drives the motor 750 to move the carriage 701 up and down based on the rough processing data obtained from the target lens shape data, thereby executing a rough processing operation on the lens LE. After completion of the rough processing operation, a finishing (finish operation) operation is started. When a bevel-finishing mode is specified, the main control portion 160 finds bevel-finishing data in accordance with the edge position data on the front and rear surfaces of the lens LE. And, the main control portion 160 drives the motor 745 to move the carriage 701 in the X-axis direction and thereby set the lens LE on a beveling groove formed in the grindstone 602*c*. Then, in accordance with the bevel-finishing data, the main control portion 160 drives the motor 720 to rotate the lens LE and simultaneously drives the motors 745 and 750 to move the carriage 701 right and left as well as up and down, thereby carrying out a bevel-finishing operation. On the other hand, when a flat finishing and grooving mode is specified, the main control portion 160 finds flat finishing data and grooving data in accordance with the target lens shape data and the edge position data on the front and rear surfaces of the lens LE. Then, the main control portion 160 drives the motor 745 to move the carriage 701 in the X-axis direction and thereby sets the lens LE on a flat portion of the grindstone 602*c*. Then, in accordance with the flat-finishing data, the main control portion 160 drives the motor 720 to rotate the lens LE and simultaneously drives the motors 745 and 750 to move the carriage 701 right and left as well as up and down, thereby executing a flat-finishing operation on the lens LE. Further, the main control portion 160 drives the motor 745 to move the carriage 701 in the X-axis direction and thereby sets the lens LE on the grindstone 842 moved to its processing position; and the main control portion 160 drives the motor 720 to rotate the lens LE and simultaneously drives the motors 745 and 750 to move the carriage 701 right and left as well as up and down in accordance with the grooving data, thereby carrying out a grooving operation on the lens LE.

Further, when a chamfering operation is specified, the main control portion 160, in the above-mentioned lens shape measuring operation, detects the edge position of the lens LE in accordance with the target lens shape data and, after then, detects the edge position existing 0.5 mm inwardly or outwardly of the radial length of the target lens shape data. This two edge position detecting operations are performed respectively on the front and rear surfaces of the lens LE and, based on the results of such detecting operations, the respective inclined conditions of the front and rear surfaces are obtained. In accordance with the respective edge positions of the front and rear surfaces and the respective chamfering amounts, the main control portion 160 finds chamfering data on the front and rear surfaces of the lens LE. Then, the main control portion 160 drives the motor 745 to move the carriage 701 in the X-axis direction and thereby sets the lens LE on the grindstone 841*a* moved to its processing position; and the main control portion 160 drives the motor 720 to rotate the lens LE and simultaneously drives the motors 745 and 750 to move the carriage 701 right and left as well as up and down in accordance with the chamfering data on the lens rear surface, thereby executing a chamfering operation on the lens rear surface. Further, the main control portion 160 drives the motor 745 to move the carriage 701 in the X-axis direction and thereby sets the lens LE on the grindstone 841*b*; and the main control portion 160 drives the motor 720 to rotate the lens LE and simultaneously drives the motors 745 and 750 to move the carriage 701 right and left as well as up and down based on the chamfering data on the lens front surface, thereby carrying out a chamfering operation on the lens front surface.

Figure 11:
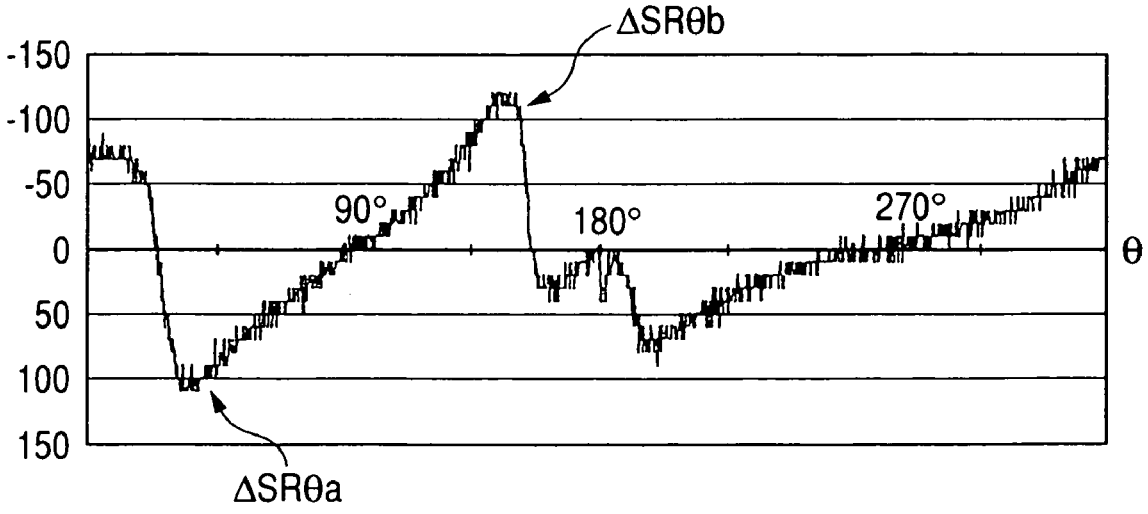
FIG. 11 is a view of differentiated data of the target lens shape data.

Incidentally, the above-mentioned foreign body detecting method can be changed in other various manners. For example, as a foreign body detecting method based on the mutual correlation between the variations of the edge position data and the variations of the target lens shape data, there can also be employed the following method. Here, FIG. 11 shows the results of differentiation of the target lens shape data shown in FIG. 9A. The differentiated data of the target lens shape data is compared with the differentiated data of the edge position data shown in FIG. 10. With respect to the portions ΔFθa, ΔFθb, ΔFθc, and ΔFθd which are respectively extracted as points having a large variation amount in FIG. 10, when the differentiated data of the target lens shape data shown in FIG. 11 are compared with the differentiated data of the edge position data, Δ SRθa which is the peak of the variation in FIG. 11 exists in the vicinity of the radial angle of ΔFθa which is the peak of the variation shown in FIG. 10; and, Δ SRθb which is the peak of the variation in FIG. 11 is exists in the vicinity of the radial angle of ΔFθb which is the peak of the variation shown in FIG. 10. However, no peak of the variation in FIG. 11 exists in the vicinity of the respective radial angles of the portions ΔFθc and ΔFθd which are respectively the peaks of the variation in FIG. 10. Therefore, it can be judged that the peaks ΔFθc and ΔFθd of the variation of the edge position data are caused by the presence of a foreign body. Thus, the foreign body detection can also be realized in such a manner that, by using the differentiated results of the edge position data and target lens shape data, it is checked whether the sharply varying points of the target lens shape data is present or not in the vicinity of the sharply varying points of the edge position data.

Further, there can also be employed another method for detecting a foreign body which, as in the case where the above-mentioned chamfering operation is specified, uses the results obtained when two edge position detecting operations are respectively performed on the front and rear surfaces of the lens LE. When a foreign body such as the tape 51 is present on the lens refractive surface, normally, the end of the foreign body rarely coincides with the lens meridian direction (the same radial angle in the edge position detection). For this reason, the edge positions are detected twice on measuring paths shifted by a given distance at the same radial angle from each other and, it is judged whether there exists a portion having a large varying amount or not in accordance with a difference between the detected edge positions. This makes it possible to detect the presence or absence of a foreign body. When no foreign body is present, the varying amount of the difference with respect to the radial angle is small. On the other hand, when any foreign body is present, a portion having a large varying amount in the difference with respect to the radial angle appears.

Figure 12A:
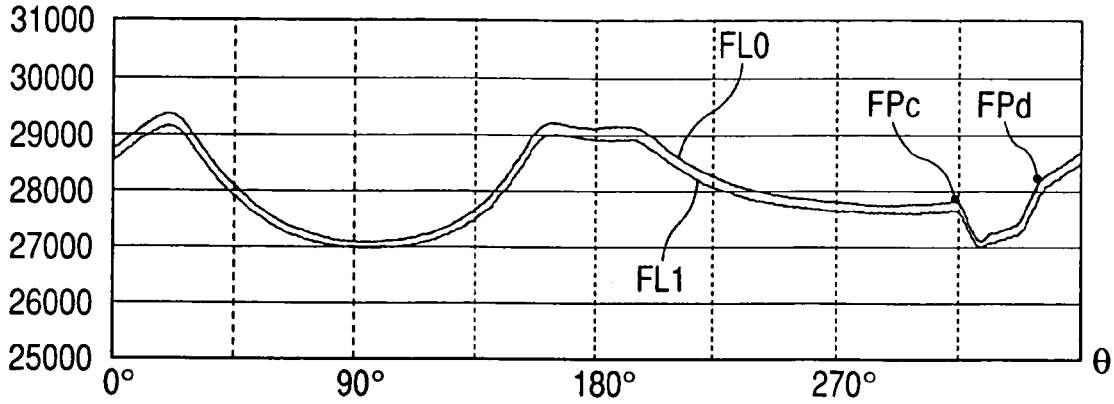
FIGS. 12A to 12C are explanatory views of a method for detecting a foreign body from a difference between two edge positions data.
Figure 12B:
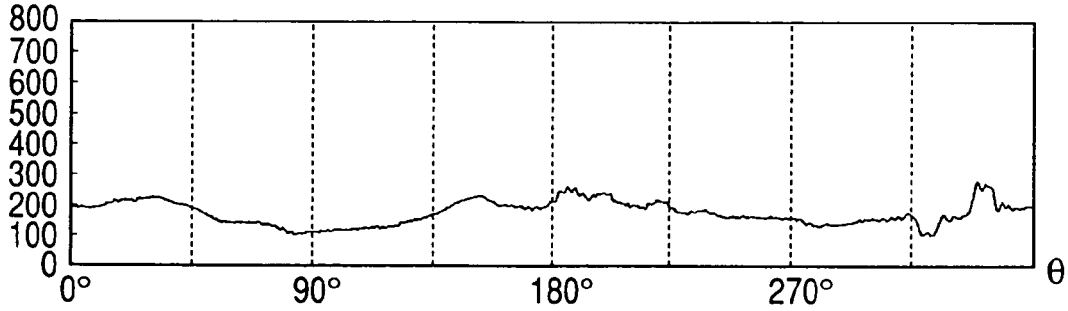
Figure 12C:
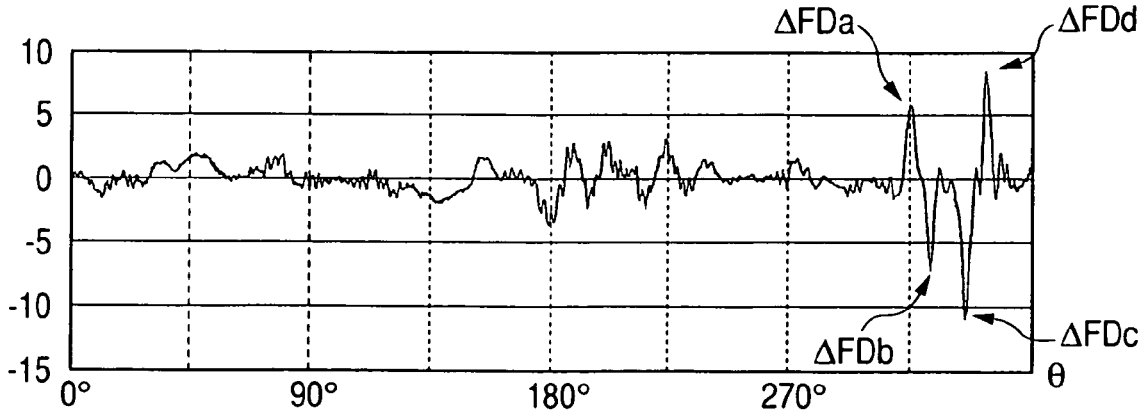

Now, description will be given here of an example of this detecting method. Here, FIG. 12A is a graphical representation of the results of edge position detection made twice on the front surface of the lens LE. In FIG. 12A, FL0, similarly in FIG. 9A, expresses measurement results obtained in a first measuring path of the target lens shape data, while FL1 expresses measurement results obtained in the second measuring path existing 0.5 mm inwardly of the first measuring path. FIG. 12B is a graphical representation of the difference data between FL0 and FL1. FIG. 12C is a graphical representation of results obtained by differentiating the difference data. Incidentally, in the differentiating process in FIG. 12C, in order to facilitate the understanding of a sharply varying tendency, the detection results of the edge positions in 1000 points are calculated by averaging them by 10 points.

In FIG. 12A, there is shown an example of the lens front surface in which a foreign body is present between two points FPc and FPd on FL0. Using the differentiating processing in FIG. 12C, it is checked whether there exists or not a point varying sharply exceeding a given threshold value; and, the presence or absence of a foreign body is detected depending on the presence or absence of such point. In this example, since there are present points Δ FDa, Δ FDb, Δ FDc, and Δ FDd which respectively exceed the threshold value ±5, it is judged that a foreign body is present in these points. By the way, in the differentiating process in FIG. 12C, the threshold value, which is used to detect the presence or absence of the foreign body, may be determined experimentally.

As described above, the presence or absence of a foreign body on the refractive surface of a lens can be detected before the lens is processed, thereby being able to prevent the defective processing of the lens.

What is claimed is:

1. An eyeglass lens processing apparatus, comprising:

a lens holding unit that holds an eyeglass lens;

a data input unit that inputs target lens shape data;

a lens measuring unit that measures a refractive surface of the held lens based on the input target lens shape data to obtain an edge position of the lens; and a controller that detects presence or absence of a foreign body on the lens refractive surface based on the obtained edge position data.

2. The eyeglass lens processing apparatus according to claim 1, wherein the controller detects the presence or absence of the foreign body based on a mutual correlation between a variation of the edge position data and a variation of the target lens shape data.

3. The eyeglass lens processing apparatus according to claim 2, wherein the controller detects the presence or absence of the foreign body based on whether an inflection point of the target lens shape data is present or not in the vicinity of an inflection point of the edge position data, or on whether a sharply varying point of the target lens shape data is present or not in the vicinity of a sharply varying point of the edge position data.

4. The eyeglass lens processing apparatus according to claim 1, wherein the lens measuring unit measures the lens refractive surface in a first measuring path based on the target lens shape data and a second measuring path arranged a given distance inwardly or outwardly of the first measuring path to obtain the edge position data, and the controller detects the presence or absence of the foreign body based on a difference between the edge position data in the first measuring path and the edge position data in the second measuring path.

5. The eyeglass lens processing apparatus according to claim 1 further comprising a lens processing unit that processes the held lens, wherein the controller limits processing of the lens when the presence of the foreign body is detected.

* * * * *